United States Patent [19]

Vandenbroucke et al.

[11] Patent Number: 4,918,893

[45] Date of Patent: Apr. 24, 1990

[54] ONE-PIECE STUD ATTACHMENT FOR SUPPORTING NON-RIGID INSULATION WITHIN A WALL STRUCTURE

[76] Inventors: Jack-Eric Vandenbroucke, 33, Lisière, St-Constant, (Quebec), Canada, J0L 1X0; Jack Vandenbroucke, 1493, Bachand, Carignan, (Quebec), Canada, J3L 4E6

[21] Appl. No.: 262,707

[22] Filed: Oct. 26, 1988

[51] Int. Cl.[5] ..... E04B 1/74

[52] U.S. Cl. ..... 52/404; 52/407; 52/712; 52/715

[58] Field of Search ..... 52/404, 407, 391, 385, 52/712, 715, 699

[56] References Cited

U.S. PATENT DOCUMENTS

| | | | |
|---|---|---|---|
| 2,602,526 | 1/1952 | Day et al. | 52/404 X |
| 3,144,733 | 8/1964 | Balinski | 52/715 X |
| 3,154,889 | 11/1964 | Monroe | 52/712 X |
| 3,355,203 | 11/1967 | Stauffer | 52/404 X |
| 3,982,373 | 6/1976 | Wilson et al. . | |
| 4,043,092 | 8/1977 | Paul et al. | 52/712 |
| 4,471,592 | 9/1984 | MacKinnon et al. | 52/712 X |
| 4,761,928 | 8/1988 | Pichette . | |

FOREIGN PATENT DOCUMENTS

| | | |
|---|---|---|
| 168119 | 6/1914 | Canada . |
| 1057928 | 6/1979 | Canada . |
| 1191320 | 6/1985 | Canada . |
| 1205970 | 6/1986 | Canada . |

*Primary Examiner*—David A. Scherbel
*Assistant Examiner*—Creighton Smith
*Attorney, Agent, or Firm*—Nixon & Vanderhye

[57] ABSTRACT

One-piece stud attachments support non-rigid insulation filling the cavities within a wall structure. Each attachment comprises two tongue portions perpendicular to each other. The first tongue portion is screwed or nailed on a wood stud, with the second tongue portion projecting into one of the cavities and penetrating the insulation to support it and prevent slippage thereof downwardly by gravity. The second tongue portion may have spikes, its free end twisted, or a forked free end to hook the insulation. The first tongue portion can also be formed with spikes penetrating the wood of the stud in order to increase the rigidity of fixation. Advantageously, the first tongue portion is made of a strip of metal sheet having its free end half folded over its other half to thereby form a U-shaped, first tongue portion which can be hooked into a hole of a metal stud.

20 Claims, 5 Drawing Sheets

ONE-PIECE STUD ATTACHMENT FOR SUPPORTING NON-RIGID INSULATION WITHIN A WALL STRUCTURE

BACKGROUND OF THE INVENTION

1. Field of the invention

The present invention relates to a one-piece stud attachment, advantageously made of metal sheet through a die stamping process and designed to support non-rigid insulation filling cavities within a wall structure thereby preventing slippage thereof downwardly by gravity.

2. Brief description of the prior art

When constructing or renovating for example a single-family dwelling, it is of conventional practice to erect walls using vertical wood or metal studs. In such walls, cavities are delimited by each pair of adjacent studs, which cavities can be easily filled with non-rigid insulation, in particular fiberglass insulation, before covering one side of the wall.

A major problem with such non-rigid insulation is that it tends to slip down by gravity after a given period of time, even if the insulation is sticked to a sheet of paper stapled to wood studs. As a result, the upper portion of the corresponding cavity becomes non-insulated.

In order to overcome the above problem, the workers which insulate walls drive a plurality of carpenter nails into the wood studs in such a manner that the nails project into the cavity. The so driven nails penetrate the fiberglass insulation to prevent the same from getting compressed down. If the walls are erected using metal studs, it is known to position some kind of metal rods across the cavity, using the holes bored through such metal studs as supports for the opposite ends of the rods. The non-rigid insulation is then passed behind or in front of the rods whereby the same provides for a certain support of the non-rigid insulation to prevent slippage of the latter downwardly by gravity.

OBJECT OF THE INVENTION

An object of the present invention is to propose a stud attachment suitable to replace the above discussed carpenter nails and rods to support the non-rigid insulation installed in the cavities of a wall. The stud attachment of the invention can be produced very easily and rapidly by metal stamping, has an increased efficiency compared with that of the conventional nails and rods in preventing slippage downwardly of the non-rigid insulation, and can be fixed either on wood or metal studs very easily and rapidly even by unskilled workers.

SUMMARY OF THE INVENTION

More specifically, according to the invention, there is provided a one-piece stud attachment for supporting non-rigid insulation filling cavities within a wall structure including a plurality of spaced apart, generally parallel studs, each of said cavities being delimited by two adjacent ones of the studs. The stud attachment comprises a first and a second tongue portions angularly disposed with respect to each other. The first tongue portion comprises means for attaching the same to one of the studs with the second tongue portion projecting into one of the cavities delimited by the latter stud. The second tongue portion penetrates the non-rigid insulation to support it and thereby prevent slippage thereof downwardly by gravity.

In accordance with preferred embodiments of the stud attachment of the invention, (a) it is produced from a metal sheet by die stamping, (b) the first tongue portion has a first half connected to the second tongue portion, and a second, free end half folded over the first half to form a U-shaped first tongue portion which can be easily hooked in the holes of a metal stud, and (c) aligned holes are bored through the two halves of the U-shaped first tongue portion to allow screwing or nailing thereof in a wood stud. The second, free end half of the first tongue portion may be provided with spikes obtained from the metal sheet during the die stamping process, which spikes penetrate the wood during nailing or screwing to increase the rigidity of fixation of the attachment to the stud.

Preferably, the second tongue portion is so formed as to hook the non-rigid insulation. For that purpose, the second tongue portion may be provided (a) with spikes obtained from the metal sheet during the die stamping process, (b) with a twisted free end, and/or (c) with a forked free end portion. As an alternative, the free end of the second tongue portion may be bent upwardly.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF THE PREFERRED EMBODIMENTS

Figure 1:
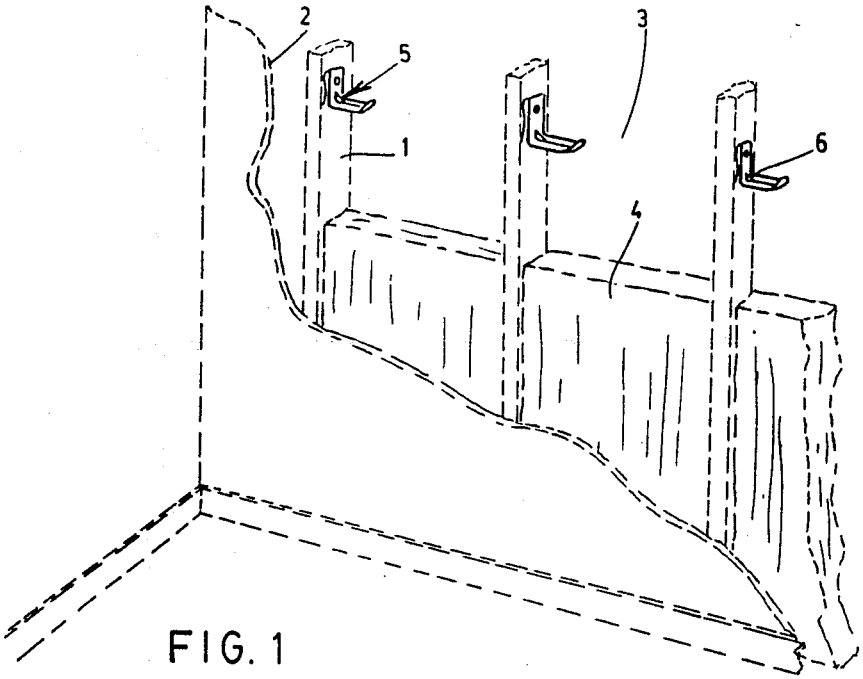
FIGS. 1 and 2 show the use of stud attachments in accordance with the present invention for supporting non-rigid insulation in cavities formed in a wall structure.
Figure 2:
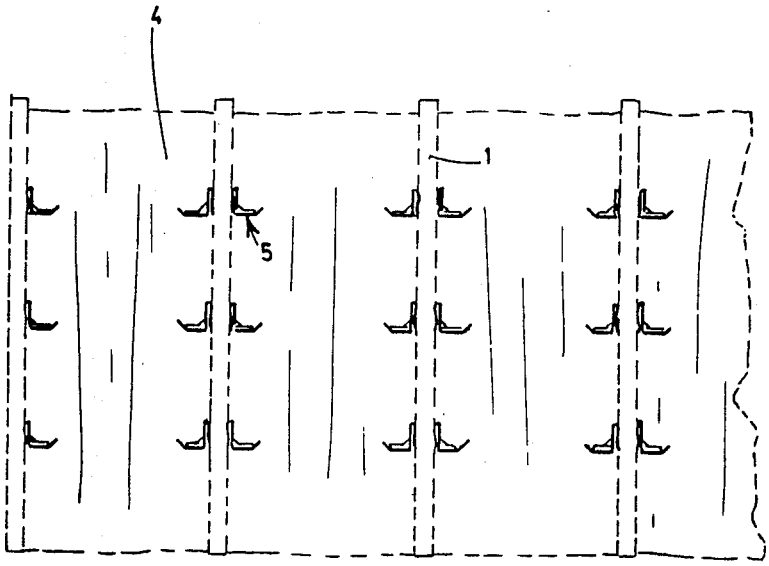

Referring to FIGS. 1 and 2 of the drawings, it is of common practice to erect walls in the construction or renovation of for example a single-family dwelling using a plurality of vertical wood studs such as 1. Although FIGS. 1 and 2 illustrate wood studs 1, it should be kept in mind that the same applies to metal studs. In such a wall structure, cavities such as 3 are delimited between each pair of adjacent studs 1, which cavities are often filled with fiberglass insulation, or with any other type of non-rigid insulation of this type, before covering one side of the wall with any suitable covering boards 2. Such insulation is very easy and rapid to install and accordingly it is widely used. A drawback of this practice, as mentioned hereinabove, is that the fiberglass heat or acoustic insulation tends to slip down by gravity after a certain period of time.

To overcome this problem, a plurality of stud attachments according to the invention such as 5 are fixed on each face of the studs 1 facing a cavity 3. After the attachments 5 have been installed, the non-rigid insulation 4 is installed in each cavity 3. During the latter operation, the horizontal tongue portion 6 of the attachments 5 projecting into a cavity 3 is penetrated into the insulation 4. It is important to penetrate the tongues 6 in the fiberglass insulation without compressing the latter (as shown in FIG. 2) so that it keeps its insulating properties. The attachment 5 is then in closed contact with the insulation and support it to prevent slippage thereof downwardly.

The different embodiments of the stud attachment in accordance with the invention described in detail hereinafter are all produced from metal sheet by means of a die stamping process.

Figure 3:
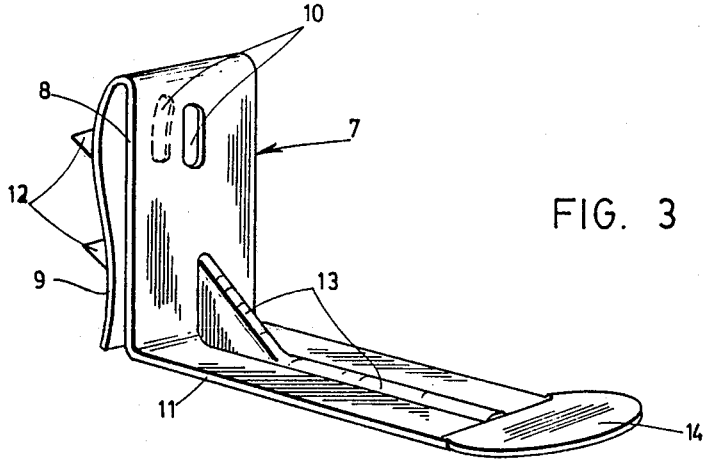
FIGS. 3, 4*a*, 4*b*, 5*a* and 5*b* illustrate a first embodiment of the stud attachment according to the invention, and the method of screwing or nailing it into a wood stud, or of hooking it in a hole of a metal stud.

The embodiment of FIG. 3 comprises a vertical tongue portion 7. The tongue 7 comprises a free end half 9 folded over the other half 8 of the tongue portion 7, which interconnects the half 9 with an horizontal tongue portion 11, to form a U-shaped portion 7. The two halves 8 and 9 have already holes 10 bored during the die stamping. The half 9 also comprises triangular spikes 12 formed from the metal sheet during the die stamping process as shown for example in FIG. 9 with respect to the spikes 34.

The generally horizontal tongue portion 11 of the embodiment of FIG. 3 is integral with the portion 7. As can be seen, the halves 8 and 9 are generally perpendicular to the tongue portion 11. The attachment of FIG. 3 is embossed at 13 in order to increase the mechanical rigidity of the same, which embossment is carried out during the die stamping process. The free end 14 of the tongue portion 11 is generally semicircular and planar, and is oriented upwardly.

Figure 4A:
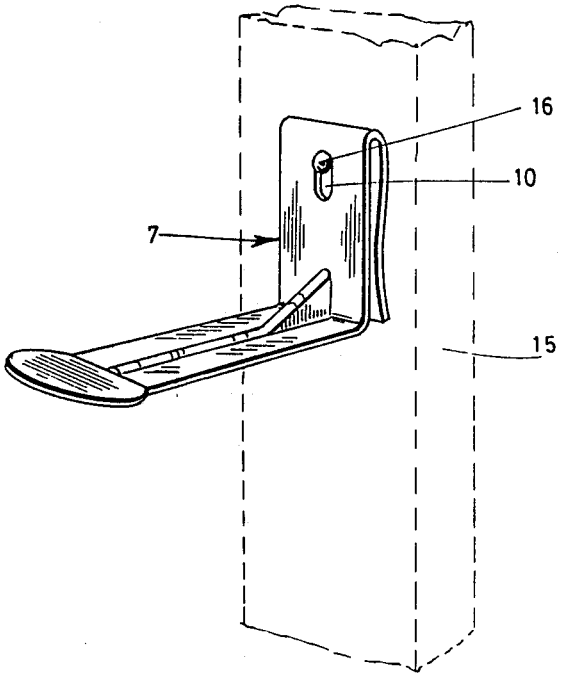
Figure 4B:
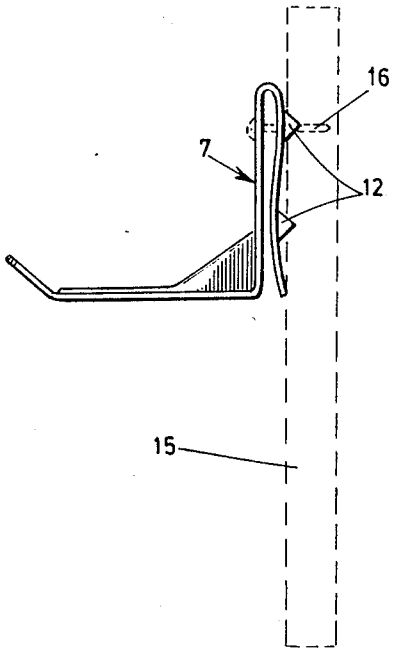

When fixed to a wood stud 15 (FIGS. 4*a* and 4*b*), the stud attachment is first, temporally attached by driving the spikes 12 in the wood using a hammer (see FIG. 4*b*). A screw or nail 16 is then drived into the wood stud 15 through the pair of aligned holes 10, as illustrated both in FIGS. 4*a* and 4*b*. As can be appreciated, the spikes 12 penetrated in the wood increase the rigidity of fixation of the attachment to the stud after it has been nailed or screwed.

Figure 5A:
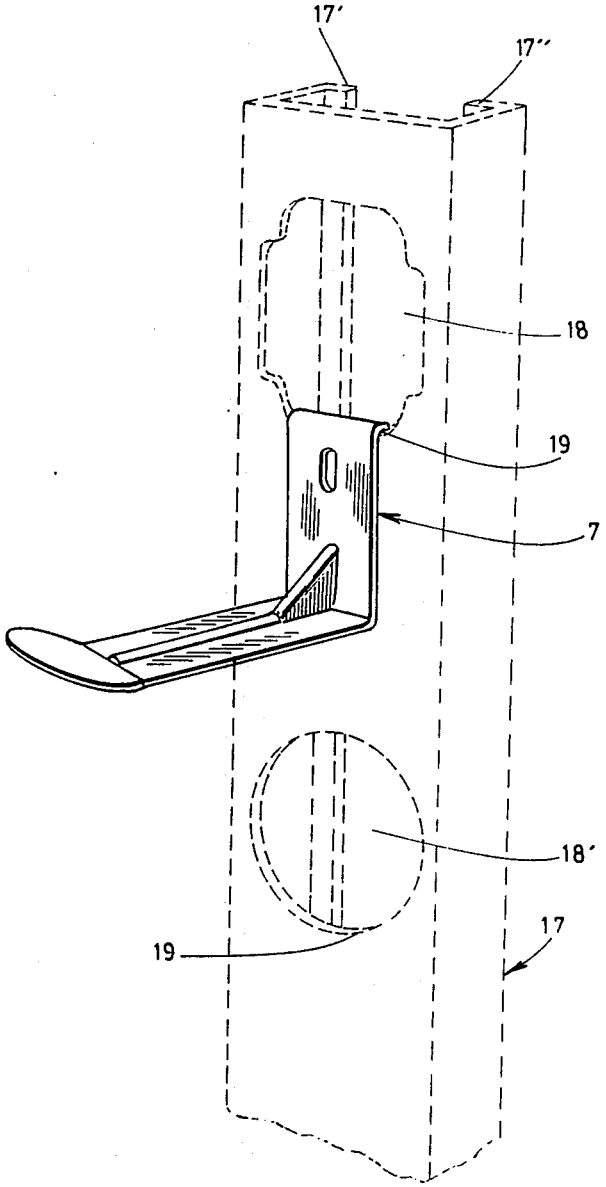

When the wall is erected from metal studs, as such metal studs available on the market always comprise generally rectangular 18 or circular 18' holes shown in FIG. 5*a* to allow passage of piping or of electric wires, the tongue portion 7 of FIG. 3 can be hooked on the lower edge such as 19 of the holes 18 or 18' with the tongue portion 11 projecting into the cavity on either side of the stud 17. For that purpose, the half 9 is passed behind the wall 20 of the metal stud 17 while the half 8 is passed in front thereof. Due to its shape shown in FIG. 5*b*, the half 9 produces a spring load on the wall 20 of the metal stud 17, whereby the stud attachment is firmly hooked.

As can be seen in FIG. 5*a*, the metal studs available on the market have a U-shaped cross section, which also defines two flanges 17' and 17''.

Figure 6:
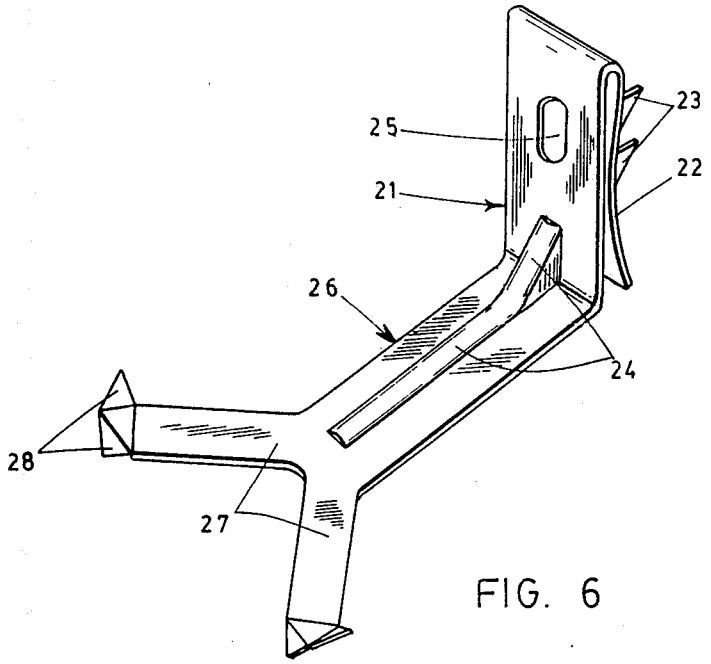
FIG. 6 is a second embodiment of the stud attachment of the invention having a U-shaped first tongue portion and a second tongue portion with a forked free end.

The embodiment of FIG. 6 comprises a vertical tongue portion 21 similar to that of FIG. 3, with its free end half 22 also provided with triangular spikes 23 having the same function as those 12 of the embodiment of FIG. 3. The spikes 23 are formed from the metal sheet during the die stamping process as described hereinabove. Of course, the vertical tongue portion 21 is also provided with aligned holes 25 bored by die stamping to allow nailing or screwing thereof in a wood stud. The horizontal tongue portion 26 has a forked free end 27. The free end of the two prongs of the forked portion 27 is provided with spikes such as 28. The embodiment of FIG. 6 is also embossed at 24 for an increased rigidity. As can be easily appreciated, the forked end 27 as well as the spikes 28 when inserted in the non-rigid insulation without compressing it hook the same.

Figure 7:
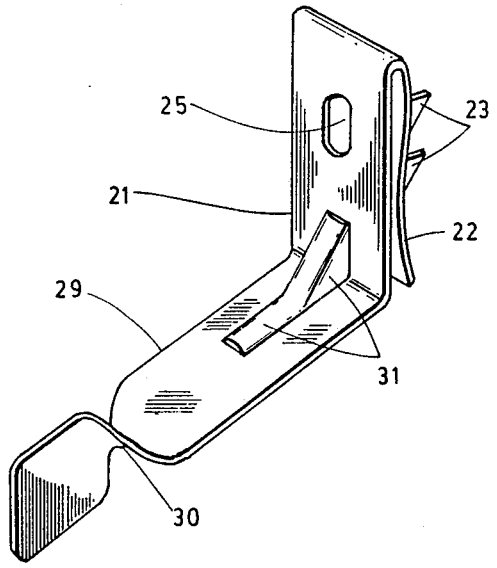
FIG. 7 is a third embodiment of the stud attachment according to the invention comprising a U-shaped, first tongue portion, and a second tongue portion with a twisted free end.

The embodiment of FIG. 7 is similar to that of FIG. 6, but does not comprise the forked free end of the horizontal tongue portion 26. Instead, the free end of its horizontal tongue portion 29 is twisted at 30. This results into an end structure which hooks the non-rigid insulation when the tongue portion 29 is penetrated therein without compressing it. The stud attachment of FIG. 7 is embossed at 31 to increase its mechanical rigidity.

Figure 8:
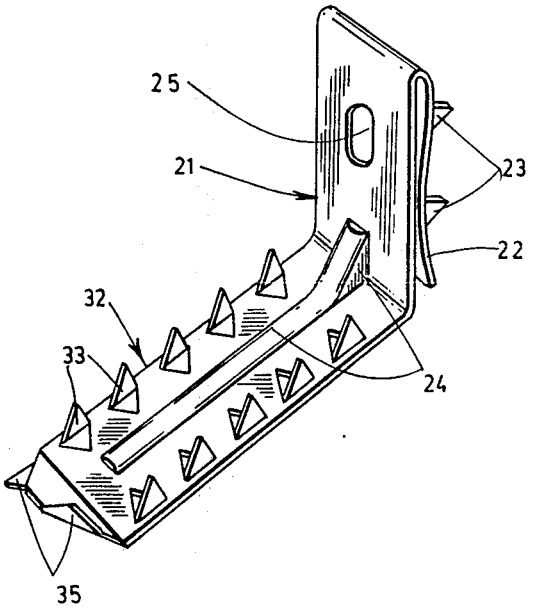
FIG. 8 is a fourth embodiment of the stud attachment of the invention including a U-shaped first tongue portion with spikes, and a second tongue portion also provided with spikes to hook the non-rigid insulation.

The embodiment of FIG. 8 comprises the vertical, U-shaped tongue portion 21, the aligned holes 25, the spikes 23 and the embossment 24 of the embodiment of FIG. 6. However, its horizontal tongue portion 32 comprises a plurality of triangular spikes such as 33 oriented upwardly and obtained from the metal sheet during the die stamping process. It also comprises end spikes 35 oriented downwardly and upwardly and also obtained from the metal sheet during the die stamping process. When the tongue portion 32 is penetrated into the non-rigid insulation, without compressing the same the spikes 33 and 35 hook the insulation to support the same efficiently.

Figure 5B:
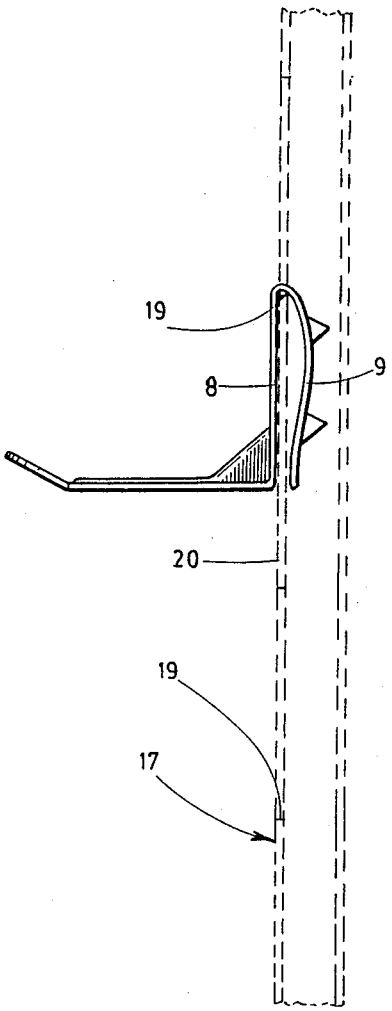

Of course, the embodiments of FIGS. 6, 7 and 8 can be nailed or screwed through their holes 25 in the same manner as described hereinabove with reference to FIGS. 4*a* and 4*b* for the embodiment of FIG. 3. The different embodiments of FIGS. 6, 7 and 8 can also be hooked on a metal stud 17 in the same manner as illustrated in FIGS. 5*a* and 5*b* in the case of the embodiment of FIG. 3.

The embodiments of FIGS. 6, 7 and 8 are particularly suitable for use in supporting non-rigid fiberglass insulation filling cavities within the sloped wall structure of a sloped roof built with a plurality of generally parallel spaced apart inclined studs. Each pair of these adjacent studs defines within such a wall structure one of the cavities filled with insulation.

Figure 9:
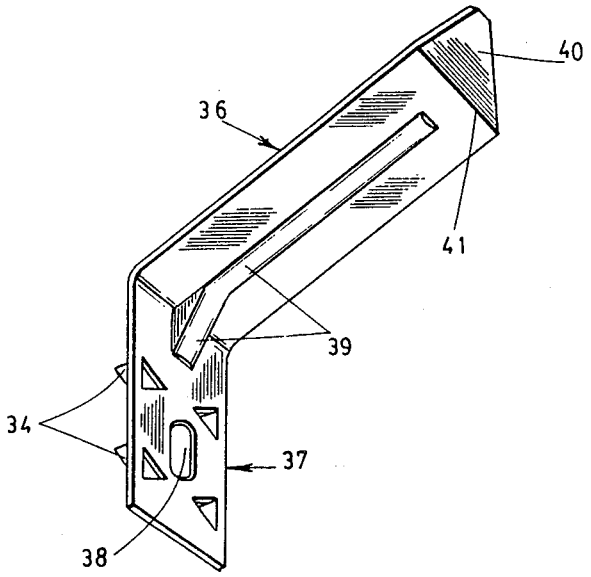
FIG. 9 illustrates a fifth embodiment of the stud attachment in accordance with the invention, including first and second tongue portions perpendicular to each other, the first tongue portion being provided with spikes and with a hole therethrough to screw or nail it into a wood stud, the second tongue portion being formed with a free end oriented upwardly.

FIG. 9 illustrates a last embodiment for the stud attachment according to the invention. The embodiment of FIG. 9 comprises two tongue portions 36 and 37 generally perpendicular to each other. This stud attachment is also embossed at 39 during the die stamping process in order to increase the rigidity of the same.

The vertical tongue portion 37 comprises a hole 38 bored during the die stamping process, and a plurality of spikes such as 34 obtained from the metal sheet of the tongue portion 37 also during the die stamping process.

The spikes 34 have the same function as those 12 of the embodiment of FIG. 3, as described hereinabove. The free end 40 of the horizontal tongue portion 36 is bent upwardly at 41 and is formed as a triangular spike.

The tongue portion 37 of FIG. 9 is first, temporally attached to the wood stud by driving the spikes 34 into the wood with a hammer. It is then nailed or screwed through the hole 38. The spikes 34, penetrating the wood increase the mechanical rigidity of fixation to the stud.

When the tongue portion 36 is inserted into the non-rigid insulation without compressing the same, the end spike 40 hooks the insulation whereby the stud attachment efficiently supports it in order to prevent slippage thereof downwardly.

As can be appreciated, the embodiment of FIG. 9 is designed for use with wood studs only as it cannot be hooked on a metal stud as shown in FIGS. 5*a* and 5*b*, as in the case of the embodiments of FIGS. 3, 6, 7 and 8.

Although the present invention has been described hereinabove by means of preferred embodiments thereof, it should be pointed out that any modification to these embodiments, within the scope of the appended claims, is not deemed to change or alter the scope and nature of the present invention.

What is claimed is:

1. A one-piece stud attachment for supporting non-rigid insulation filling cavities within a wall structure including a plurality of spaced apart, generally parallel studs, each of said cavities being delimited by two adjacent ones of said studs, said stud attachment comprising a first and a second tongue portions angularly disposed with respect to each other, said first tongue portion comprising means for attaching the same to one of said studs with the second tongue portion projecting into one of said cavities delimited by the latter stud, which second tongue portion penetrating said non-rigid insulation to support it and thereby prevent slippage thereof downwardly by gravity, wherein at least one of said first and second tongue portions is embossed in order to increase the mechanical rigidity of said stud attachment.

2. A stud attachment according to claim 1, wherein said stud attachment is made of metal sheet through a die stamping process, and wherein said at least one of the first and second tongue portions is embossed during the stamping process.

3. A stud attachment according to claim 1, wherein the first tongue portion is made of a strip of metal sheet, said strip comprising a first, free end half and a second half interconnecting said first half with the second tongue portion, said first half being folded over the second half to form said U-shaped, first tongue portion.

4. A stud attachment according to claim 1, in which said first tongue portion comprises a plurality of spikes designed to penetrate a stud made of wood.

5. A stud attachment according to claim 1, in which the first half of said first tongue portion is provided with a plurality of spikes designed to penetrate a stud made of wood.

6. A one-piece stud attachment for supporting non-rigid insulation filling cavities within a wall structure including a plurality of spaced apart, generally parallel studs, each of said cavities being delimited by two adjacent ones of said studs, said stud attachment comprising a first and a second tongue portions angularly disposed with respect to each other, said first tongue portion comprising means for attaching the same to one of said studs with the second tongue portion projecting into one of said cavities delimited by the latter stud, which second tongue portion penetrating said non-rigid insulation to support it and thereby prevent slippage thereof downwardly by gravity, in which said second tongue portion comprises means for hooking said non-rigid insulation thereon, wherein said hooking means comprises said second tongue portion formed with a free end bent upwardly.

7. A stud attachment according to claim 6, in which the first tongue portion is U-shaped, whereby it can be hooked in a hole provided in a stud made of metal sheet.

8. A stud attachment according to claim 7, wherein the first tongue portion is made of a strip of metal sheet, said strip comprising a first, free end half and a second half interconnecting said first half with the second tongue portion, said first half being folded over the second half to form said U-shaped, first tongue portion.

9. A stud attachment according to claim 6, in which a hole is bored through the first tongue portion, whereby said first tongue portion can be nailed or screwed through said hole on a stud of said wall structure.

10. A stud attachment according to claim 8, in which said U-shaped, first tongue portion comprises aligned holes through said folded first and second halves of the strip, whereby said first tongue portion can be nailed or screwed through said aligned holes on a stud of said wall structure.

11. A stud attachment according to claim 6, in which said first tongue portion comprises a plurality of spikes designed to penetrate a stud made of wood.

12. A stud attachment according to claim 8, in which the first half of said first tongue portion is provided with a plurality of spikes designed to penetrate a stud made of wood.

13. A stud attachment according to claim 11, wherein said stud attachment is made by a metal stamping process, and wherein said spikes are formed from the metal material during the stamping process.

14. A stud attachment according to claim 12, wherein said stud attachment is made of metal sheet through a die stamping process, and wherein said spikes of the first free end half are formed from the metal sheet during the stamping process.

15. A stud attachment according to claim 8, wherein said first half is so folded over the second half of the first tongue portion as to produce a spring load on the metal sheet of said stud.

16. A one-piece stud attachment for supporting non-rigid insulation filling cavities within a wall structure including a plurality of spaced apart, generally parallel studs, each of said cavities being delimited by two adjacent ones of said studs, said stud attachment comprising a first and a second tongue portions angularly disposed with respect to each other, said first tongue portion comprising means for attaching the same to one of said studds with the second tongue portion projecting into one of said cavities delimited by the latter stud, which second tongue portion penetrating said non-rigid insulation to support it and thereby prevent slippage thereof downwardly by gravity, in which said second tongue portion comprises means for hooking said non-rigid insulation thereon, wherein said hooking means comprises said second tongue portion formed with a plurality of spikes.

17. A stud attachment according to claim 16, wherein said stud attachment is made of metal sheet through a die stamping process, and wherein said spikes of the second tongue portion are formed from the metal sheet during the stamping process.

18. A one-piece stud attachment for supporting non-rigid insulation filling cavities within a wall structure including a plurality of spaced apart, generally parallel studs, each of said cavities being delimited by two adjacent ones of said studs, said stud attachment comprising a first and a second tongue portions angularly disposed with respect to each other, said first tongue portion comprising means for attaching the same to one of said studs with the second tongue portion projecting into one of said cavities delimited by the latter stud, which second tongue portion penetrating said non-rigid insulation to support it and thereby prevent slippage thereof downwardly by gravity, in which said second tongue portion comprises means for hooking said non-rigid insulation thereon, wherein said hooking means comprises said second tongue portion formed with a twisted free end.

19. A one-piece stud attachment for supporting non-rigid insulation filling cavities within a wall structure including a plurality of spaced apart, generally parallel studs, each of said cavities being delimited by two adjacent ones of said studs, said stud attachment comprising a first and a second tongue portions angularly disposed with respect to each other, said first tongue portion comprising means for attaching the same to one of said studs with the second tongue portion projecting into one of said cavities delimited by the latter stud, which second tongue portion penetrating said non-rigid insulation to support it and thereby prevent slippage thereof downwardly by gravity, in which said second tongue portion comprises means for hooking said non-rigid insulation thereon, wherein said hooking means comprises said second tongue portion formed with a forked free end.

20. A stud attachment according to claim 19, wherein said forked free end comprises spikes.

* * * * *